United States Patent [19]

Shirazi

[11] Patent Number: 4,744,116

[45] Date of Patent: May 17, 1988

[54] STRETCHER

[76] Inventor: Masoud M. Shirazi, Flat 3, 23 St. Peters Road, Leicester, LE2 1DF, Leicestershire, England

[21] Appl. No.: 940,054

[22] Filed: Dec. 10, 1986

[30] Foreign Application Priority Data

Dec. 14, 1985 [GB] United Kingdom ..... 8530843

[51] Int. Cl.[4] ..... A61G 1/00

[52] U.S. Cl. ..... 5/82 R; 264/257; 264/314; 425/DIG. 14; 427/341; 427/342; 428/68; 428/74; 428/290; 428/425.6

[58] Field of Search ..... 5/82 R, 508; 264/257, 264/314, 317; 425/DIG. 14, DIG. 19; 427/341, 342, 389.9; 428/68, 74, 290, 425.6

[56] References Cited

U.S. PATENT DOCUMENTS 1,275,306 8/1918 Rosenshine ..... 5/82 R

FOREIGN PATENT DOCUMENTS 2023010 12/1979 United Kingdom ..... 5/82 R
2105978 4/1983 United Kingdom ..... 5/82 R

*Primary Examiner*—Alexander Grosz
*Attorney, Agent, or Firm*—Charles E. Brown; Charles A. Brown

[57] ABSTRACT

A compact stretcher is disclosed which is erectable upon requirement. In a preferred embodiment, stretcher poles each consist of a tube of textile material impregnated with a moisture-curable polyurethane which is received within an impervious outer cover tube. The tubes and stretcher base are carried in a folded condition until erection is required when the contents of a canister containing compressed air and water are introduced into each pole. Once the two poles have been extended and the polyurethane cured, the poles are inserted into respective cavities of a canvas base to a stretcher.

11 Claims, 1 Drawing Sheet

STRETCHER

The present invention relates to a pole for a stretcher and a stretcher embodying the pole.

The simplest type of stretcher consists of a kind of litter composed of two poles sometimes supported by cross-bars upon which a canvas or other material is stretched. The rigid poles make stretchers bulky to store, carry or otherwise transport.

An object of the present invention is to provide stretcher of compact construction and which can be readily erected as may be required.

In accordance with the broadest aspect of the present invention there is provided a pole for a stretcher comprising a foraminous tube impregnated with a fluid-curable resin, the impregnated tube being received within a fluid-impervious outer tube, means for inflating the foraminous tube and means for introducing resin-curing fluid into the formanimous tube.

The means for inflating the foraminous tube and the means for introducing resin-curing fluid may be stored in a container, such as a canister. The canister or canisters are conveniently valve or otherwise controlled to permit operation on demand. In a preferred embodiment of the invention the fluid-curable material is a moisture curable polyurethane and the resin-curing fluid is water.

The material impregnated with the moisture curable material may be of knitted or woven construction and composed of natural and/or synthetic fibers, conveniently glass-fibers. In the preferred embodiment of the invention the material is in the form of a tape wrapped helically around a foraminous, inflatable mould form. However, the material may also extend around only part of the tube. Also in the preferred embodiment the covered foraminous tube is bonded to the impervious outer cover.

Figure 1:
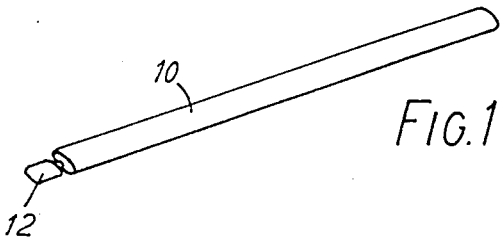
Figure 2:
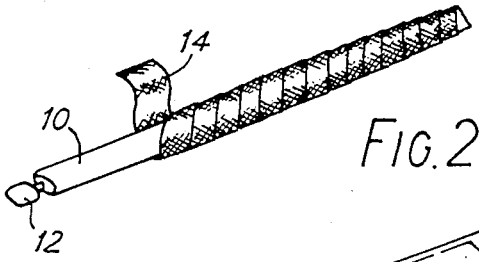
Figure 3:
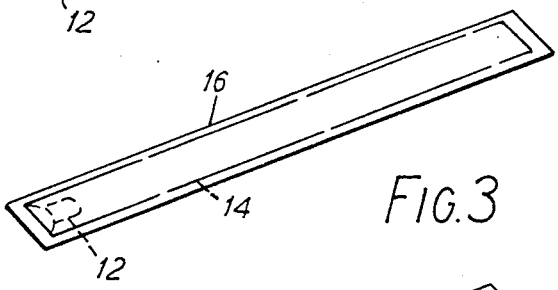
Figure 4:
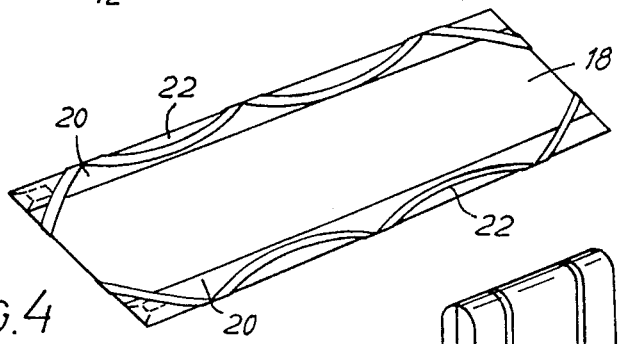
Figure 5:
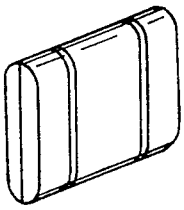
Figure 6:
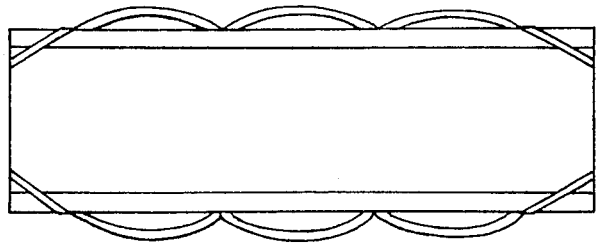

The invention will now be described further by way of example with reference to the accompanying drawings in which:

FIG. 1 is a perspective view of a tubular, foraminous mould form for a stretcher pole including valved canister means for introducing compressed air and water into the tube, FIG. 2 is a similar view to FIG. 1 but showing the tube partly wrapped with a tape covering, FIG. 3 shows the wrapped tube of FIG. 2 received within an impervious outer cover, FIG. 4 shows a stretcher base including carrying handles ready for receiving two stretcher poles, FIG. 5 shows the folded stretcher in the condition in which it is carried or otherwise transported, and FIG. 6 shows an erected stretcher complete with two rigid poles.

In FIG. 1, a tube of a foraminous material is designated 10, the tube being of knitted or woven construction. A valved canister 12 is connected to one end of the tube in such a manner that when the valve is operated, the canister contents of compressed air and water are introduced into the body of the tube.

A tape 14 (FIG. 2) which is knitted or woven from glass fibers and impregnated with a moisture curable polyurethane resin is helically wrapped round the tube 10. The moisture curable polyurethane may be of the type such as that sold under the trade mark SCOTCHFLEX (Registered Trade Mark) or SCOTCHCAST (Registered Trade Mark). Alternatively, moisture curable polyurethanes such as those sold under the Trade Marks BAYCAST or DYNACAST may be employed.

The wrapped tube is then inserted into and bonded to a flexible cover 16 (FIG. 3) of an impervious material such as polyethene. Alternatively, polythene, nylon or polyester film bonded to aluminium foil may be used.

FIG. 4 shows the stretcher base 18 which may be of traditional canvas, of a reinforced plastics sheet or other material which can support the weight of a body. The base includes a pair of grooves 20 along the longitudinal sides into which the flexible pole of FIG. 3 is inserted. The base also includes a plurality of carrying handles 22 by means of which the stretcher can be carried.

The assembled flexible stretcher shown in FIG. 4 is then folded into the shape illustrated in FIG. 5, the dimensions of the folded stretcher being 30 cm by 6 cm by 25 cm. In this condition a lightweight, readily transported and stored package is provided.

When the stretcher is to be used, it must first be erected and to do this the package of FIG. 5 is first opened out again to the condition shown in FIG. 4. The valves on the two canisters are then opened so that the pressurised air inflates the two tube covers 16 and water penetrates into the tape 14 to activate the moisture curable polyurethane, the time taken to set up and cure being approximately 5 minutes.

Whereas in the described embodiment of the invention both the compressed air and water were included in a single canister, it will be appreciated that the air and water can be stored in, and dispensed from, separate containers. Further, the invention is not restricted to the use of air as a means of inflating the tube since any other gaseous medium may be used. Similarly, whereas water was used in the described embodiment to cure the moisture curable material, the invention is not restricted in this respect.

It will be appreciated that when in an inflated condition, the inner tube 10 provides a mould form from around which the tape can be set into a hardened, rigid condition. Certain types of material, such as closely woven or densely knitted material, when knitted into a closed form, such as a closed tube, are capable of being inflated without the use of an inflatable mould form. However, when with these types of material, it is desirable to include an inflatable sleeve which strengthens the construction by providing a composite construction rigid with the outer sleeve once the fluid-curable material has set.

What is claimed is:

1. A pole for a stretcher comprising a foraminous tube impregnated with a fluid-curable resin, a fluid-impervious outer tube, containing the foraminous tube, means for inflating the foraminous tube and means for introducing resin-curing fluid into the formanimous tube.

2. A pole as set forth in claim 3 wherein the fluid is water.

3. A pole as set forth in claim 1 wherein the fluid-curable resin is a moisture-curable polyurethane.

4. A pole as set forth in claim 1, wherein an inflatable mould form is provided around which the foraminous tube is supported whilst the resin cures.

5. A pole as set forth in claim 4 wherein the foraminous tube is in the form of a tape wrapped around at least a part of the inflatable mould form.

6. A pole as set forth in claim 4 wherein the inflatable mold form is of a knitted or woven material.

7. A pole as set forth in claim 6 wherein the material is composed of natural and/or synthetic fibers.

8. A pole as set forth in claim 1 wherein the foraminous tube is of a knitted or woven material.

9. A pole as set forth in claim 1 wherein both the means for inflating the foraminous tube and the means for introducing resin-curing fluid are canister contained.

10. A pole as set forth in claim 9 wherein a common canister is provided.

11. A lightweight, erectible stretcher comprising a patient bed portion having a pole-receiving section along each longitudinal edge in each of which a pole as claimed in claim 1 is received.

* * * * *